US012435569B2

(12) United States Patent
Tian et al.

(10) Patent No.: US 12,435,569 B2
(45) Date of Patent: Oct. 7, 2025

(54) DIRECTIONAL WELL HYDRAULIC CLUTCH DRILL STRING FULL ROTATION CONTROLLER

(71) Applicants: Southwest Petroleum University, Chengdu (CN); Nantong Xieming Technology Co., Ltd., Nantong (CN); Sichuan Xieming Technology Co., Ltd., Chengdu (CN)

(72) Inventors: Jialin Tian, Chengdu (CN); Lei Cha, Chengdu (CN); Lin Teng, Chengdu (CN); Lanhui Mao, Chengdu (CN)

(73) Assignees: SOUTHWEST PETROLEUM UNIVERSITY, Chengdu (CN); NANTONG XIEMING TECHNOLOGY CO.. LTD., Nantong (CN); SICHUAN XIEMING TECHNOLOGY CO., LTD., Chengdu (CN)

( * ) Notice: Subject to any disclaimer, the term of this patent is extended or adjusted under 35 U.S.C. 154(b) by 0 days.

(21) Appl. No.: 18/362,324

(22) Filed: Jul. 31, 2023

(65) Prior Publication Data

US 2025/0116159 A1 Apr. 10, 2025

(30) Foreign Application Priority Data

Jun. 29, 2023 (CN) ..... 202310783881.8

(51) Int. Cl.

| | |
|---|---|
| ***E21B 7/04*** | (2006.01) |
| ***E21B 4/00*** | (2006.01) |
| ***E21B 4/02*** | (2006.01) |

(52) U.S. Cl.
CPC ..... *E21B 7/04* (2013.01); *E21B 4/003* (2013.01); *E21B 4/02* (2013.01)

(58) Field of Classification Search
CPC ..... E21B 7/04; E21B 4/003; E21B 4/02
See application file for complete search history.

(56) References Cited

U.S. PATENT DOCUMENTS 10,584,535 B1 * 3/2020 Carpenter ..... E21B 7/20
2018/0363380 A1 * 12/2018 Clausen ..... E21B 7/062

* cited by examiner

*Primary Examiner* — Kristyn A Hall
(74) *Attorney, Agent, or Firm* — CENTRAL CALIFORNIA IP GROUP, P.C.; Andrew D. Fortney

(57) ABSTRACT

The disclosure is in the technical field of oil drilling, and in particular relates to a directional well hydraulic clutch drill string full rotation controller, including a rotary assembly, a power assembly and a control assembly. It has two working states: compound drilling and directional drilling. According to the change of the tool face, adjusting the rotation speed of the upper drill string or the displacement of drilling fluid may change the working state of the controller and complete the directional drilling work. The directional well hydraulic clutch drill string full rotation controller has a low cost and high safety and reliability. When oriented, the drill string keeps rotating, which greatly reduces the friction of the drill string system, reduces the stick-slip vibration phenomenon of the drill bit, and thus increases the ROP. The research and development of this technology is of great significance to the petroleum industry.

20 Claims, 11 Drawing Sheets

DIRECTIONAL WELL HYDRAULIC CLUTCH DRILL STRING FULL ROTATION CONTROLLER

TECHNICAL FIELD

The invention relates to the technical field of oil drilling, in particular to a directional well hydraulic clutch drill string full rotation controller for steerable drilling.

BACKGROUND OF THE INVENTION

Shallow oil and gas resources can't fully meet the needs of energy extraction, and oil and gas drilling are developing into complex conditions such as ultra-deep and long horizontal distance wells. Compared to conventional wells, horizontal wells and extended-reach wells can make the contact area between the wellbore and the oil and gas reservoir larger, thereby improving oil recovery rate and saving development costs. Horizontal wells and extended-reach wells can be applied to the exploration and development of oil and gas wells under various special conditions. As the well structure becomes more and more complex, the quality of the drilling equipment will directly affect the efficiency, safety and economic benefits of the drilling operation. In order to ensure the smooth operation of the drilling project, the reliability and stability of the drilling equipment is very important. As oil and gas production is increasingly oriented to ultra-deep strata and deep-sea areas, exploration and production are increasingly difficult. Therefore, it is necessary to develop directional drilling equipment with high accuracy, efficiency and reliability.

Therefore, it is of great significance to develop a directional well hydraulic clutch drill string full rotation controller for steerable drilling. The directional well hydraulic clutch drill string full rotation controller can control the upper drill string speed and drilling fluid displacement. Engineers can observe changes of tool face through MWD instruments, and adjust the two parameters according to actual needs. When the directional well hydraulic clutch drill string full rotation controller is used for directional drilling, the drill string keeps rotating throughout the whole process, and only the lower BHA (bottom hole assembly) casing keeps sliding axially. This greatly reduces the frictional resistance of the drill string system and stick-slip vibration of the drill bit, and increases the ROP (rate of penetration). The directional wells hydraulic clutch drill string full rotation controller has high safety and reliability and low accident handling costs. Therefore, the research and development of this technology is of great significance to the development of the entire petroleum industry.

SUMMARY OF THE INVENTION

The purpose of the present invention is to provide a directional well hydraulic clutch drill string full rotation controller, in order to explore and solve the related problems of the directional drilling engineering described in the background art, and improve the accuracy of the wellbore trajectory. The directional well hydraulic clutch drill string full rotation controller has two working states: compound drilling and directional drilling. When the controller is in compound drilling, the upper drill string keeps rotating, the forward torque generated by the controller is greater than the reverse torque generated by the drill bit breaking rock and the screw drilling tool, and the drill bit is drilling in one direction. The lower drill assembly housing rotates forward.

When the controller is in directional drilling, the forward torque is equal to or slightly larger than the reverse torque transmitted from the lower part, the controller shell and the lower drilling tool shell remain stationary, the trajectory of the drill bit is nonlinear, and the rotational speed of the upper drill string is called static drive speed. When the drill string rotation speed is greater than the static drive speed, the controller is in the compound drilling state. According to the change of the tool face, adjusting the rotation speed of the upper drill string or the displacement of drilling fluid may change the working state of the controller and complete the directional drilling work.

The magnitude of the reaction torque is different in different formations. When on the ground, the reaction torque is pre-calculated according to the drilling formation information, so as to change the flow channel size in the control assembly. The pressure drop across the rotor changes, as does the forward torque.

The technical scheme of the present invention is: a directional well hydraulic clutch drill string full rotation controller, located between the upper drill string and the bottom hole assembly, comprises a rotation assembly, a power assembly and a control assembly. The rotation assembly includes an upper mandrel, an upper bearing part, a first bearing positioning part, a second bearing positioning part, a bearing group, a lower bearing part or member, an upper casing, an adapter, and a water cap joint. The rotating assembly is connected with the drill string (e.g., at an upper end of the rotating assembly), which can realize the independent rotation of the rotating assembly (e.g., and inner rotating part thereof) and the outer casing. The lower bearing part (and, optionally, an upper bearing part) are on the upper mandrel and secured thereto by threads (e.g., a threaded or screw-type fitting), the upper mandrel transmits the torque of the drill string to an upper living hinge, and the first bearing positioning part and the second bearing positioning part are adjacent to the bearing group (e.g., respectively near an outer ring and an inner ring of the bearing group) and transmit the drilling pressure downward. The upper end of the water cap joint passes through a straight thread adapter, and the two structures divert the drilling fluid.

The power assembly includes a cross universal joint shaft 10, a fluid conversion joint 11, a rotor 12, a stator housing 13, an inner bushing 14, a flexible shaft 15, a conversion housing 16, an upper cover 17, a first bearing 18, an oil duct 19, an oil sealing screw 35, a second bearing 20 and a connector 21. The power assembly generates a forward torque that balances the counter torque of the drill bit through the interference fit of the rotor 12, the inner bushing 14 and the hydraulic action of the pressure difference, which is sequentially transmitted by the stator casing 13. The rotor 12, the inner bushing 14 and the stator housing 13 actually function as a screw pump, and the flexible shaft balances the planetary motion of the rotor.

The control assembly includes a control shell, an anti-drop ring, a positioning sleeve, a central tube, an upper controller, a lower controller, a piston, a lead screw, a lead screw nut, a motor, a receiving coil, a power supply, a stability control mandrel, a cylindrical needle roller, a stability control housing and a flow control system circuit. The control assembly is configured to control of the forward torque and prevent the reverse rotation of the stator housing (e.g., a nail shell) to ensure the stability of the tool face. Different flow channel opening sizes have different pressure drops at different or opposite ends of the rotor, thus changing the magnitude of the forward torque.

The flow control system circuit may comprise a main control circuit, a motor control circuit, a main control power supply circuit, a power conversion circuit, a reset circuit and a wireless receiving circuit. The main control circuit is based on an STM32F103C8 (e.g., STM32F103C8T6) minimum system (e.g., microcontroller having on-board flash memory, one or more USB interface/bus control functions, a CAN interface, one or more timers, one or more analog-to-digital converters [ADCs], and one or more other [e.g., I2C, USART, SPI, etc.] communications interfaces), to process the signal of the wireless receiving module and issue control instructions. The motor control circuit comprises two relays, two diodes, two transistors and resistors, which can control the motor. The main control power supply circuit comprises five capacitors. The power conversion circuit comprises a 24V to 5V circuit and a 5V to 3.3V circuit; the 24V to 5V circuit may be based on a pulse width modulating (PWM) buck DC/DC converter integrated circuit such as a TD1509P5, specifically comprising an interface (e.g., P2) connected to the power supply, three diodes, three capacitors, and an inductor. The 5V to 3.3V circuit is based on an adjustable and/or fixed voltage regulator integrated circuit such as the AMS1117 and four capacitors. The reset circuit comprises a resistor, a capacitor, and a switch button. The wireless receiving circuit is based on a multiband GSM and/or GPRS integrated circuit or module such as the SIM800C module and a receiving coil to receive control signals (e.g., from the ground through which the drilling string is drilling).

Both the adapter and the water cap joint are configured with radial through holes and other through holes (or first through holes and second through holes). The drilling fluid flows through the cavity of the upper mandrel, and flows from the through holes to the annulus of the shell, and can be fully decelerated at the water cap joint. The adapter is configured with a third through hole, so that a first part of the drilling fluid in the casing annulus flows into the rotor cavity, and a second part of the drilling fluid flows into the sealed cavity formed by the rotor and the inner bushing through a corresponding fourth through hole, and the first and second parts of the drilling fluid complete a confluence and flow into the lower BHA.

The flexible shaft is hollow, having an upper end connected to an end of the rotor by threads (e.g., a threaded or screw-type fitting), and a front end with a rubber part to increase the service life (e.g., of the flexible shaft and/or the directional well hydraulic clutch drill string full rotation controller). The seal prevents the drilling fluid from flowing into the cavity at the end of the rotor, and a lower end of the flexible shaft is connected with the connector (e.g., without a load).

The connecting head has an upper end with an upper cover configured to prevent drilling fluid from flowing into an interior of the first bearing, and the first bearing and the second bearing are inside the connecting head. The second bearing can rotate only in the forward direction. There is an oil duct between the first and second bearings, lubricating oil can be injected through the joint before assembly, and sealing is ensured by an oil sealing screw. The oil duct comprises through holes evenly distributed at 90° in a circumferential direction, so that the oil passages are connected.

The movement of the controller is restricted by the anti-drop ring and the positioning sleeve. The controller includes six flow channels at equal circumferential intervals, and the pressure difference between different or opposite ends of the controller is adjusted by controlling the size of the opening(s) in the flow channel(s).

The stability control mandrel includes a front end with an L-shaped through hole, so that the drilling fluid in the directional well hydraulic clutch drill string full rotation controller is confluent. The cylindrical needle roller is between the stability control mandrel and the stability control housing (e.g., in or near an arc-shaped groove), and its diameter is slightly smaller than the maximum gap of the groove. When the stator housing begins to move in a reverse direction, the distance between the cylindrical needle roller and the stability control housing groove becomes smaller, stopping the reverse rotation by friction. The greater the movement in the reverse direction, the greater the friction.

Compared with the prior art, the present invention has the following beneficial effects: (1) Compared with the traditional sliding directional drilling, the directional well hydraulic clutch drill string full rotation controller reduces the frictional resistance of the drill string system and the drill bit, and the stick-slip vibration improves the ROP; (2) Through the ground control, the working state of the directional well hydraulic clutch drill string full rotation controller can be changed at any time; (3) Compared with the rotary steering system, the directional well hydraulic clutch drill string full rotation controller has low manufacturing cost and high reliability.

BRIEF DESCRIPTION OF THE DRAWINGS

In the drawings, the same reference numerals are used for the same components to illustrate the principles of the present invention only and are not drawn to actual scale.

Part names in the figures: 1. upper mandrel, 2. upper bearing member, 3. first bearing positioning piece, 4. second bearing positioning piece, 5. bearing group, 6. lower bearing member, 601. upper shell, 7. rotary shell, 8. adapter, 9. water cap joint, 10. cross cardan shaft, 101. upper twist, 11. fluid adapter, 12. rotor, 13. stator housing, 14. internal bushing, 15. flexible shaft, 151. rubber parts, 152. seals, 16. conversion housing, 17. upper cover, 18. first bearing, 19. oil duct, 20. second bearing, 21. connector, 22. control shell, 23. anti-drop ring, 24. controller, 25. positioning sleeve, 26. center tube, 32. stability control mandrel, 33. cylindrical needle roller, 34. stability control housing, 35. oil sealing screw, 240. runner port, 241. spline, 242. lead screw, 243. lead screw nut, 245. receiving coil, 247. upper controller, 249. piston, 250. motor, 251. power supply, 252. lower controller.

DETAILED DESCRIPTION OF THE INVENTION

Figure 1:
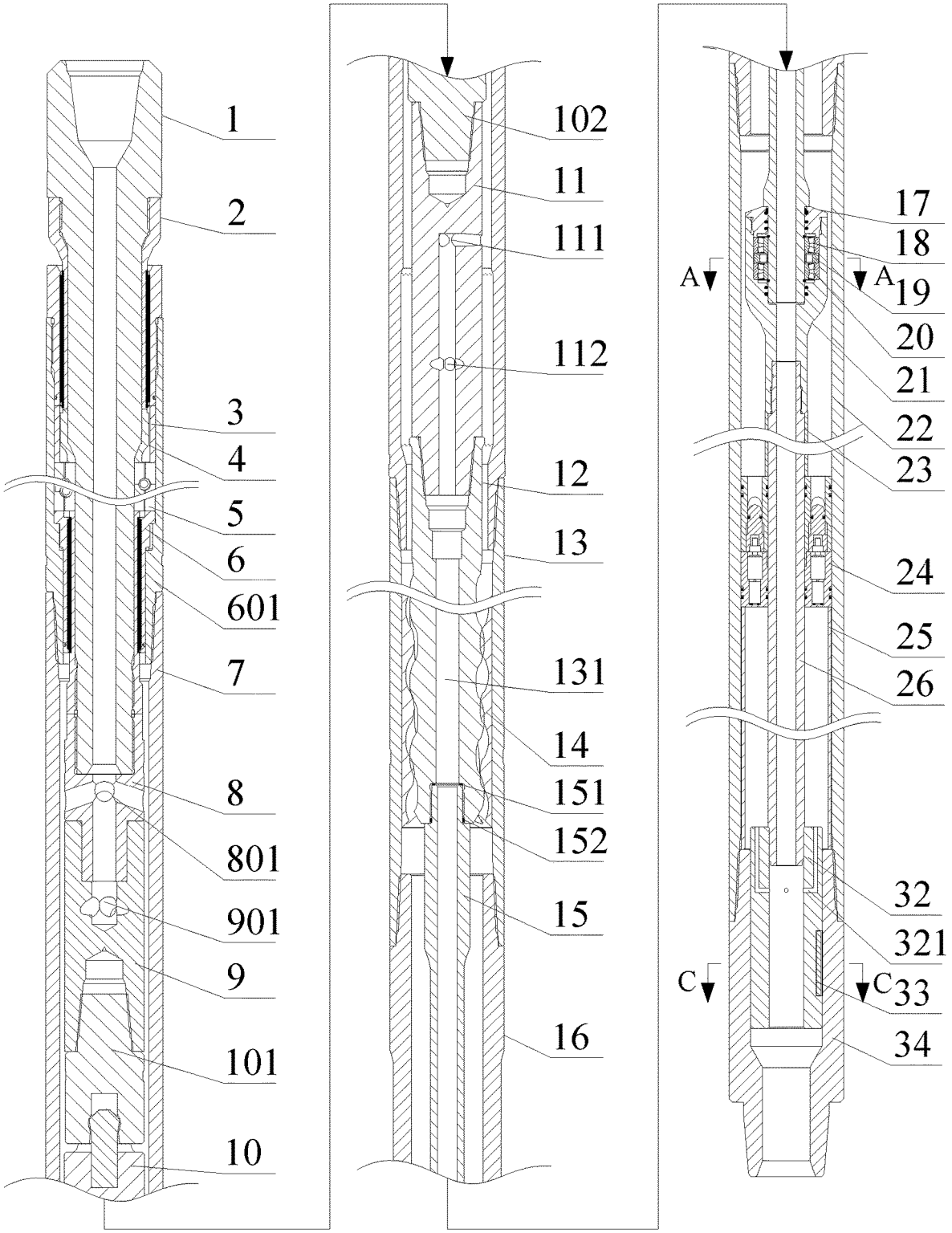
FIG. 1 is a structural representation of the present invention.

The present invention will be further described below in conjunction with the accompanying drawings:

Referring to FIG. 1, the technical solution of the present invention is: a directional well hydraulic clutch drill string full rotation controller, located between the upper drill string and the lower drill string assembly, comprising a rotating assembly, a power assembly, and a control assembly. The rotating assembly includes an upper mandrel 1, an upper bearing member 2, a first bearing positioning member 3, a second bearing positioning member 4, a bearing group 5, and a lower bearing member 6, an upper casing 601, a rotating casing 7, an adapter 8, and a water cap joint 9; an upper end of the rotating assembly is connected with the drill string, which can independently rotate the inner rotating part and the casing; and the upper bearing member 2 and the bearing positioning member 3 are connected by threads at the upper mandrel 1; the upper mandrel 1 transmits the torque of the drill string to the upper living hinge 101, and the first bearing positioning member 3 and the second bearing positioning member 4 respectively position the outer and inner rings of the bearing group 5 and transmit the drilling pressure downward. The upper end of through a straight thread, and the water cap joint 9 and the adapter 8 make the drilling fluid flow.

The power assembly includes a cross universal joint shaft 10, a fluid adapter 11, a rotor 12, a stator housing 13, an inner bushing 14, a flexible shaft 15, a conversion housing 16, an upper cover 17, a first bearing 18, an oil duct 19, an oil sealing screw 35, a second bearing 20 and a connector 21. The power assembly generates a forward torque that balances the counter torque of the drill bit through the interference fit of the rotor 12, the inner bushing 14 and the hydraulic action of the pressure difference, which is sequentially transmitted by the stator casing 13. The rotor 12, the inner bushing 14 and the stator housing 13 actually function as a screw pump, and the flexible shaft balances the planetary motion of the rotor.

Figure 2:
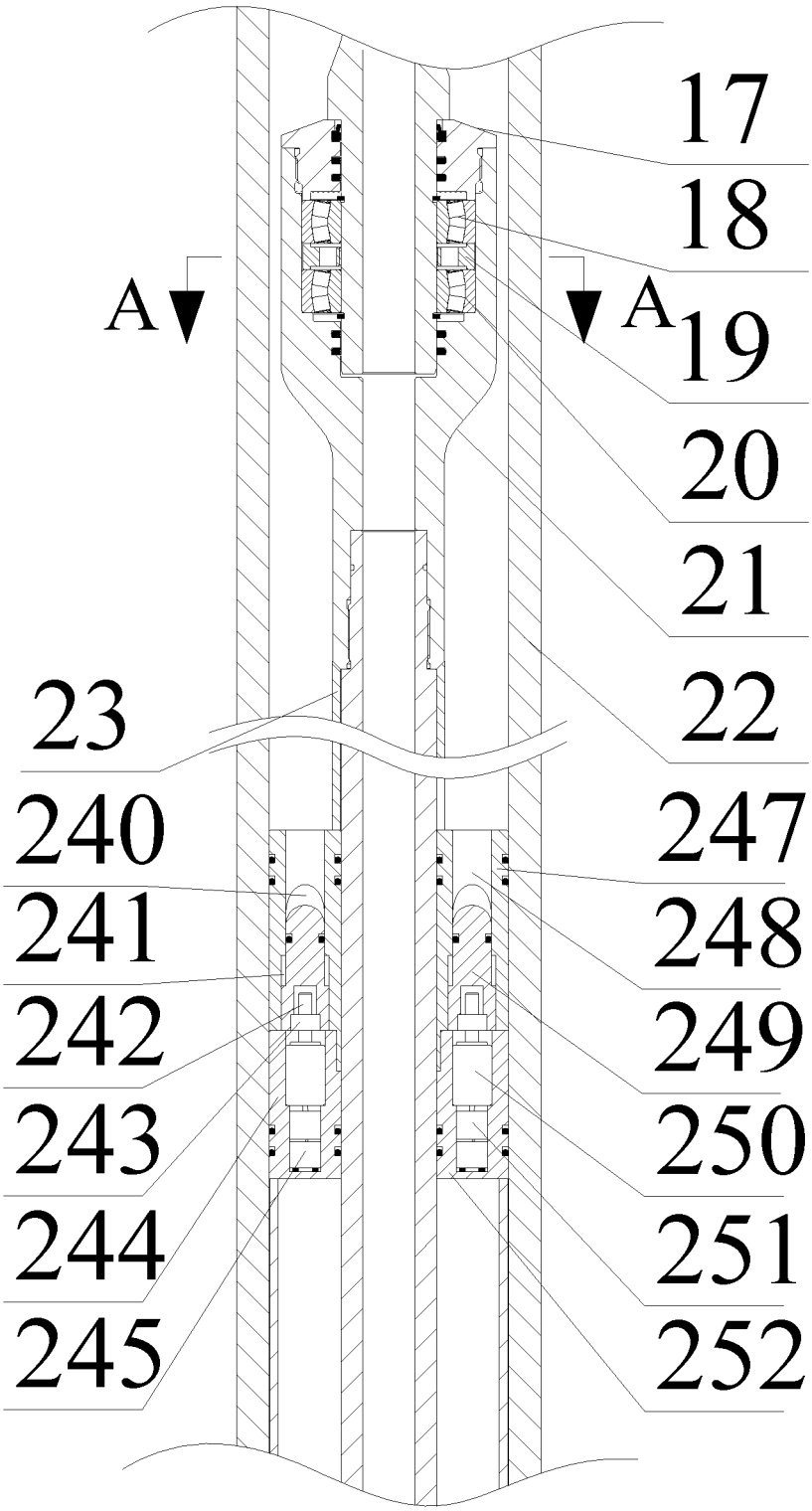
FIG. 2 is a schematic structural diagram of a control assembly.
Figure 3:
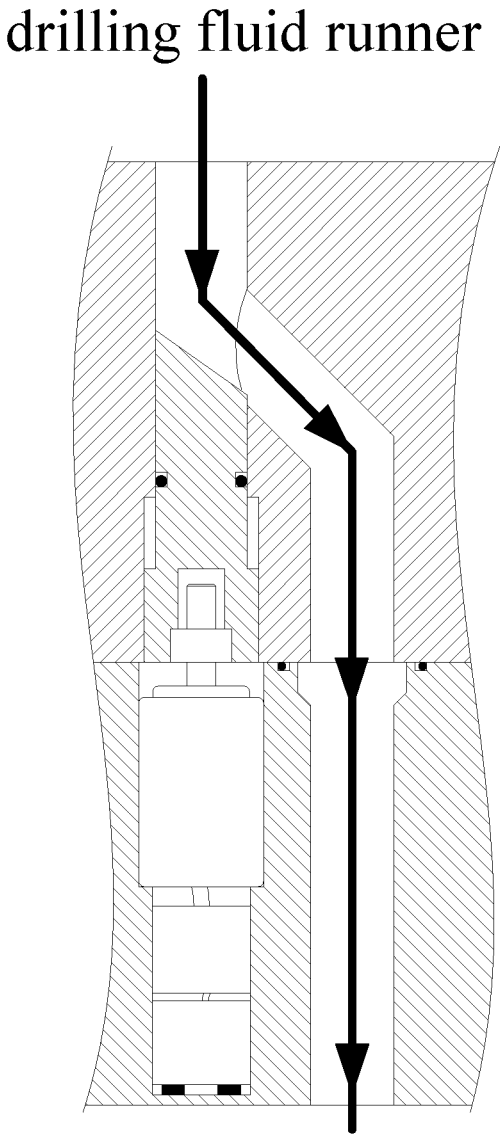
FIG. 3 is a schematic diagram of a flow channel.
Figure 4A:
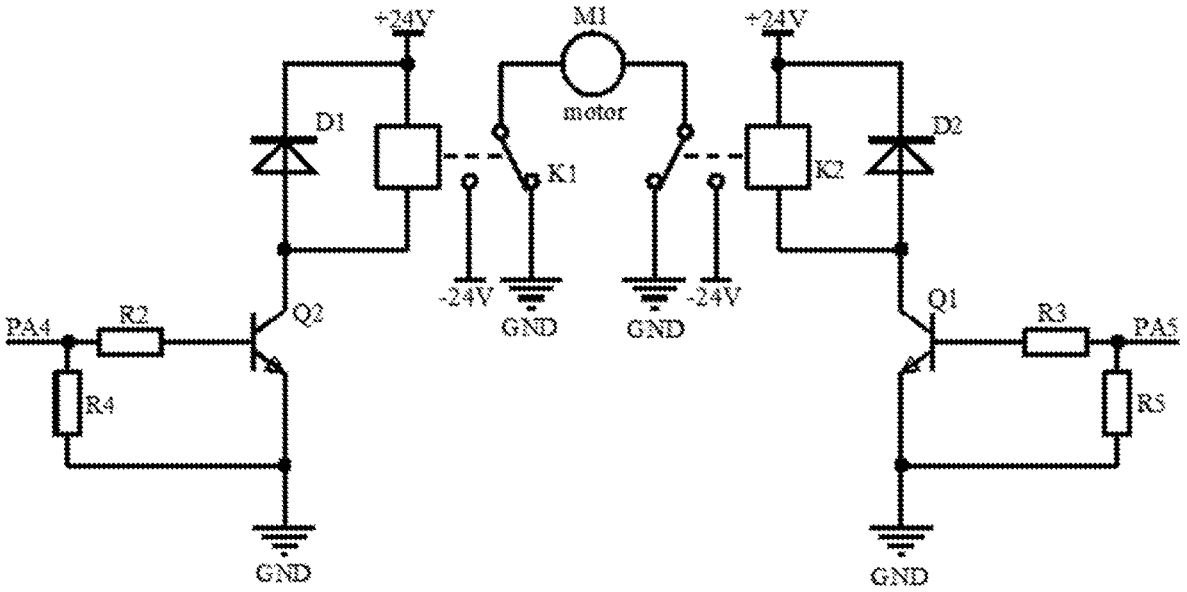
FIGS. 4A-C are diagrams of a motor control circuit and a power conversion circuit.
Figure 4B:
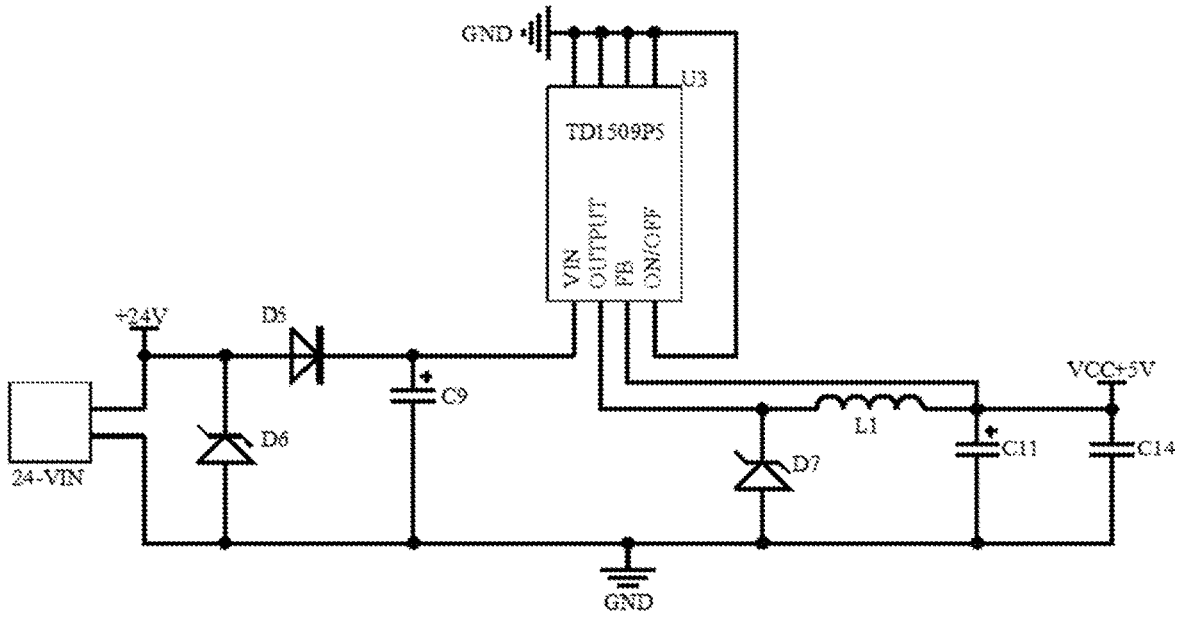
Figure 4C:
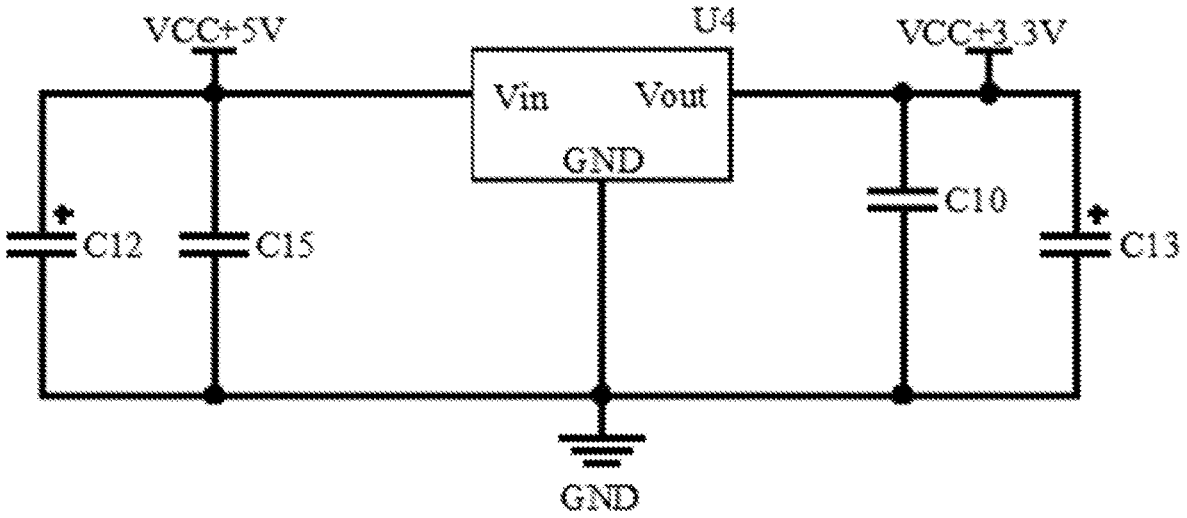
Figure 5A:
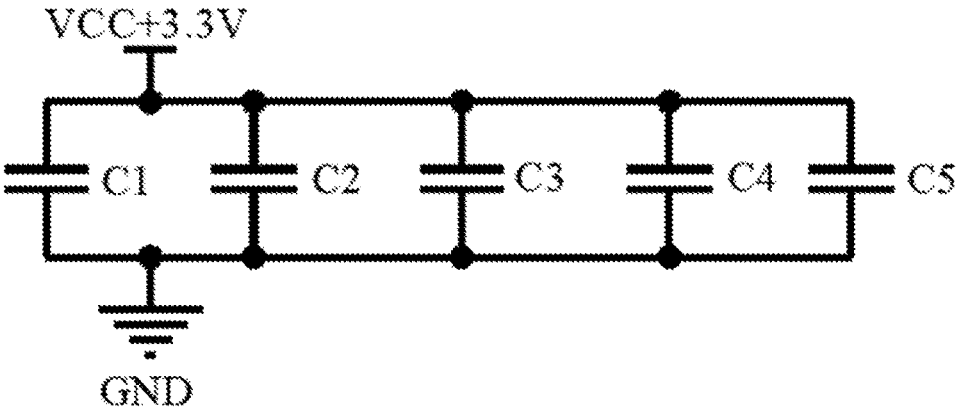
FIGS. 5A-C are circuit diagrams of the main control system.
Figure 5B:
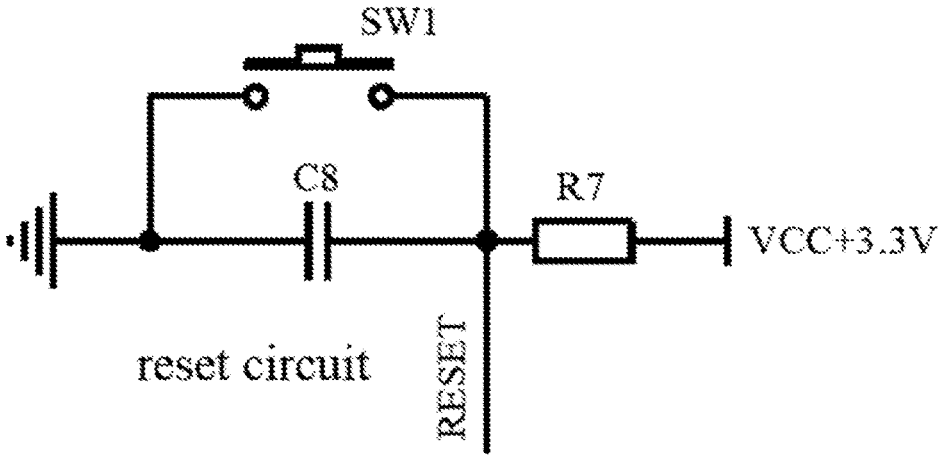
Figure 5C:
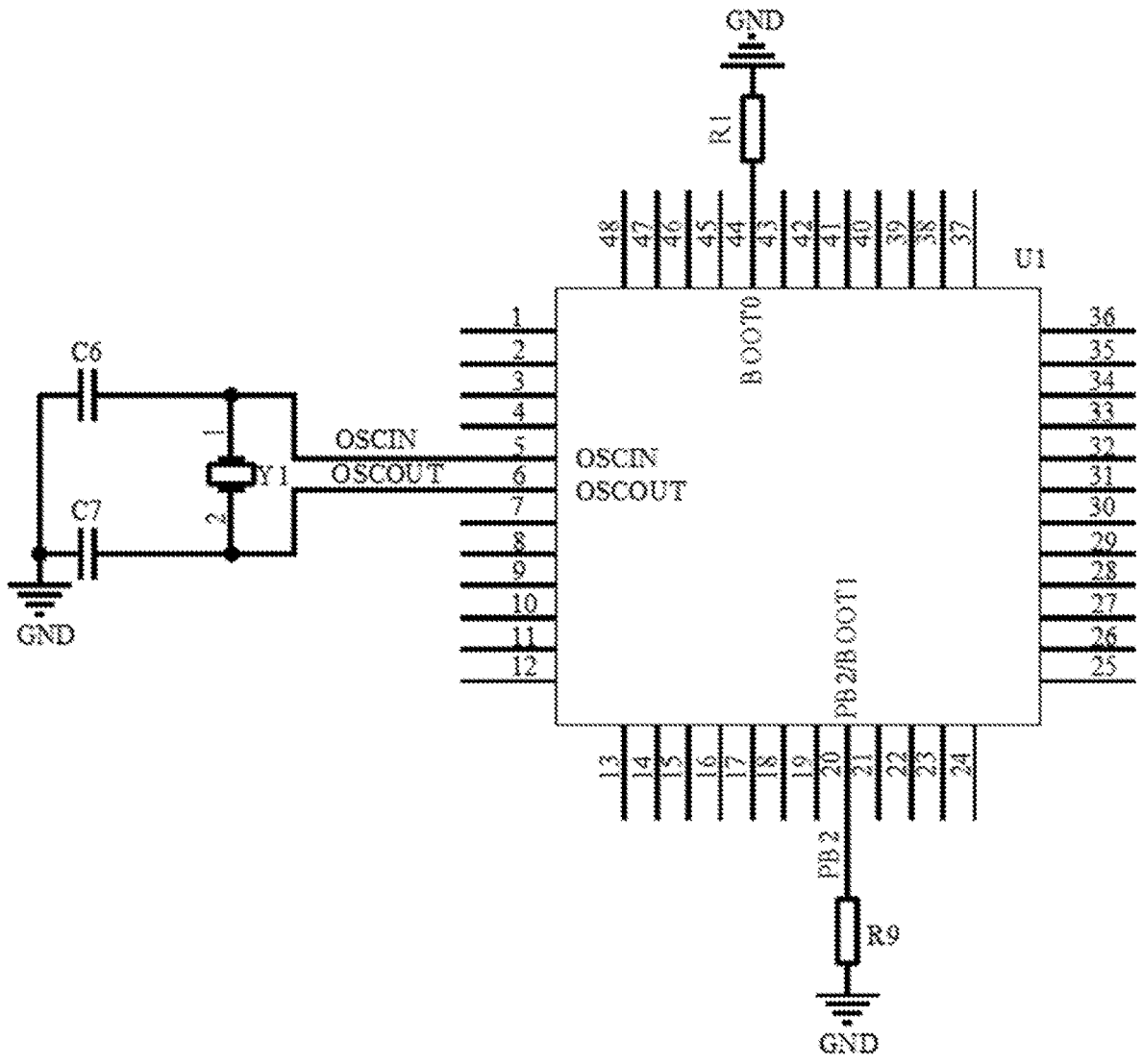

Referring to FIG. 2 and FIG. 3, the control assembly includes a control housing 22, an anti-drop ring 23, a positioning sleeve 25, a central tube 26, an upper controller 247, a lower controller 252, a piston 249, a lead screw 242, a screw nut 243, a motor 250, a receiving coil 245, a power supply 251, a stabilization control mandrel 32, a cylindrical needle roller 33, and a stabilization control housing 34. The power supply 251 provides power to the flow control system and the motor 250, ensuring that the entire system is working. The control assembly can control the magnitude of the forward torque and prevent the reverse rotation of the stator housing 13 to ensure the stability of the tool face. Different flow channel opening sizes have different pressure drops at both ends of the rotor 12, thereby changing the magnitude of the forward torque.

Referring to FIGS. 4A-C and FIGS. 5A-C, the flow control system receives a control signal from the ground through a receiving coil and transmits the control signal to the GSM and/or GPRS integrated circuit or module (e.g., the SIM800C module). After processing, the control signal is transmitted to the microcontroller (e.g., an STM32F103C8T6 minimum system), and the main control chip (e.g., the STM32F103C8T6) gets the control signal and controls the motor. The two output ports PA4 and PA5 output the control signal to the motor control circuit, and the motor control circuit performs forward and reverse control of the motor. The motor 250 rotates forward and pushes the piston 249 upward, at this time the runner area becomes smaller, and the motor 250 reverses and drags the piston 249 down to increase the runner opening. The power conversion circuit converts the power supply provided by the power supply 251 into the voltage for each integrated circuit, such as the main control chip.

In a specific example, both the adapter 8 and the water cap joint 9 have radial through holes 801 and other through holes 901. The drilling fluid flows through the cavity of the upper mandrel 1 to the casing annulus, and the drilling fluid sufficiently decelerates at the water cap joint 9. The fluid adapter 11 is provided with third and fourth through holes 111 and 112, so that a first part of the drilling fluid in the casing annulus flows into the cavity of the rotor 12, and a second part of the drilling fluid flows into the sealed cavity formed by the rotor 12 and the inner bushing 14 through the through hole 112. The parts of the drilling fluid do not communicate with each other until the L-shaped through hole is confluent and flows into the lower BHA.

The flexible shaft 15 is a hollow shaft, which has an upper end screwed to the end of the rotor 12, and the front end is provided with a rubber piece 151 to increase the service life. The seal 152 prevents the drilling fluid from flowing into the cavity 131 at the end of the rotor 12, and the lower end of the flexible shaft 15 is connected to the connector 21 without a load. The upper end of the connecting head 21 is provided with an upper cover 17 to prevent the drilling fluid from flowing into the interior, thereby protecting the bearing, and the first bearing 18 and the second bearing 20 are inside the connecting head 21. The second bearing 20 can rotate only in the forward direction. An oil duct 19 is between the two bearings, lubricating oil can be injected through the joint before assembly, and the sealing is ensured by the oil sealing screw 35. The oil duct 19 has through holes evenly distributed at 90° in the circumferential direction, so that the oil passages communicate with each other.

The movement of the controller 24 is restricted by the anti-drop ring 23 and the positioning sleeve 25; the controller 24 includes with six flow passages 248 at equal intervals in the circumferential direction, and each flow passage 248 is controlled by a piston 249 to control the size of the flow passage opening 240, thereby adjusting the control. The piston 249 is connected with the motor 250; the motor 250 is connected with the lead screw 242; the piston 249 is fixed with the lead screw nut 243, and the lead screw nut 243 is driven to move axially by the rotation of the motor 250 and drives the piston 249 to move axially. The piston 249 cooperates with the upper controller 247 through the splines 241 to implement and/or fulfill circumferential positioning and axial movement. The upper controller 247 and the lower controller 252 cooperate through the splines 241 to facilitate the positioning of the upper and lower flow channels during assembly. The signal from the ground controls the motor.

Figure 6A:
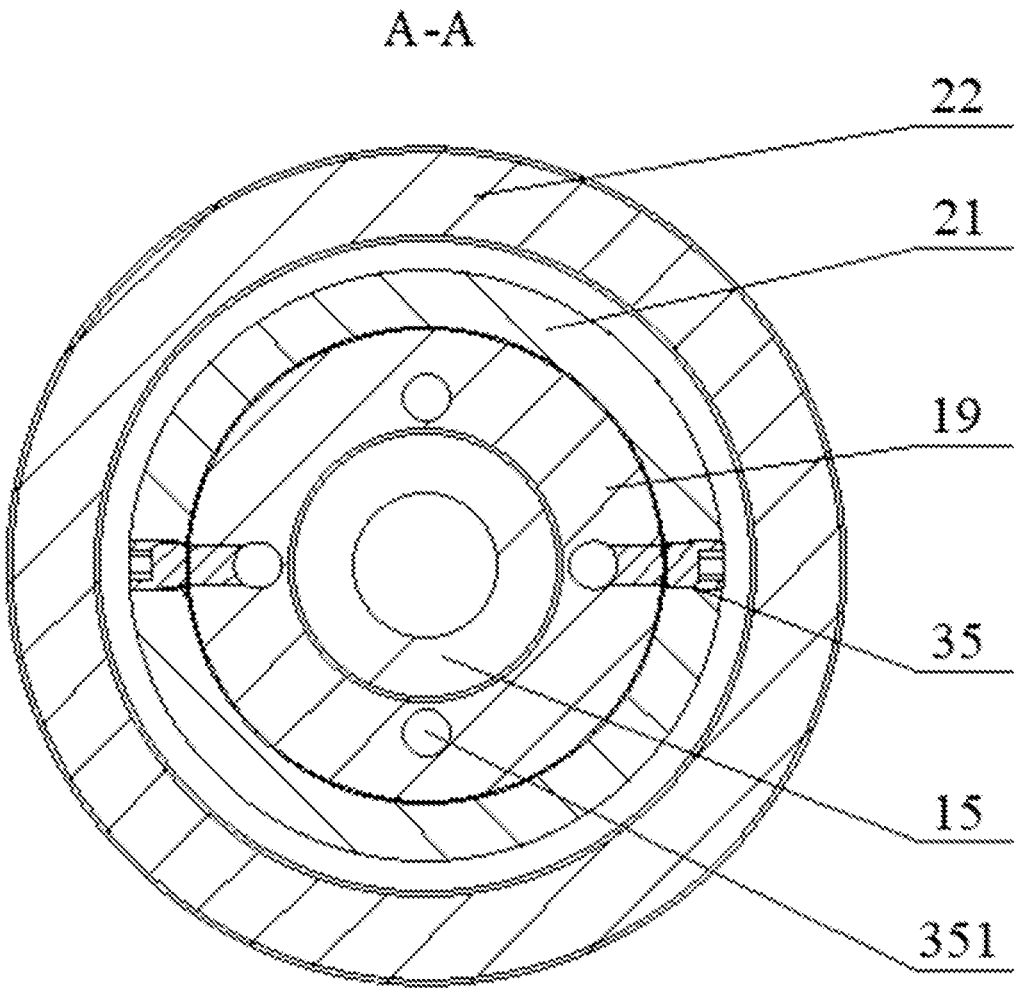
FIGS. 6A-B are sectional views of each part.
Figure 6B:
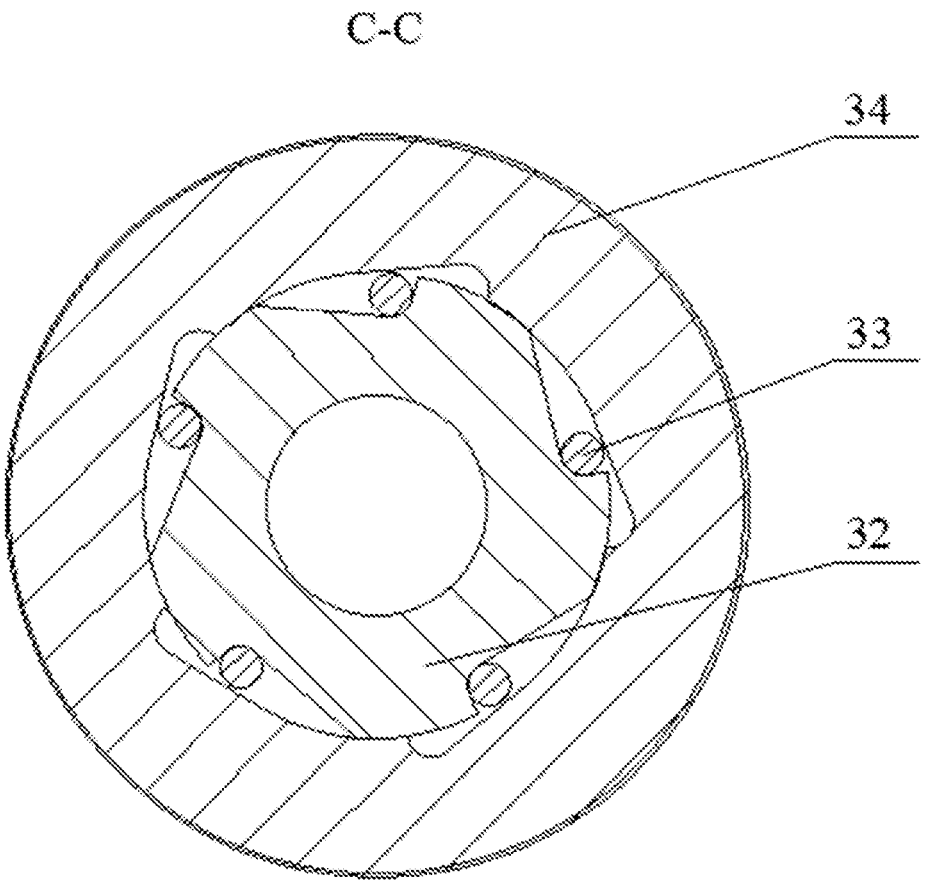

Referring to FIGS. 6A-B, in a specific example, the front end of the stability control mandrel 32 has an L-shaped through hole 321 to allow the drilling fluid inside the directional well hydraulic clutch drill string full rotation controller to join (e.g., with drilling fluid from other L-shaped through holes 321). The cylindrical needle roller 33 is in an arc-shaped groove in the stability control mandrel 32, or between the stability control mandrel 32 and the stability control shell housing 34, and the diameter of the cylindrical needle roller 33 is slightly smaller than the maximum gap of the groove. When the stator housing 13 begins to move in a reverse direction, the pitch of the grooves or space in the openings between the cylindrical needle roller 33 and the stability control housing 34 becomes smaller, and the reverse rotation is stopped by friction. As the stator moves a greater distance in the reverse direction, the friction increases. The inner and outer rings of the first bearing 18 of the connector 21 are all interference fit, the inner ring of the second bearing 20 has a clearance fit, and the outer ring and the inner cavity of the connector 21 have an interference fit, so that the connector 21 can rotate only in the positive direction. When the forward torque is large enough, the connecting head 21 keeps rotating in the forward direction, and the torque is transmitted from the central tube 26 to the stabilization control mandrel 32, and the stabilization control sub joint does not work. When the tool face is unstable and the stator housing 13 starts to move in the reverse direction, the stability control mandrel 32 rotates forward, and the gap between the cylindrical needle roller 33 and the inner wall of the stability control housing 34 decreases continuously. Furthermore, the reverse rotation of the stator housing 13 is prevented, and the tool face is stabilized.

Figure 7A:
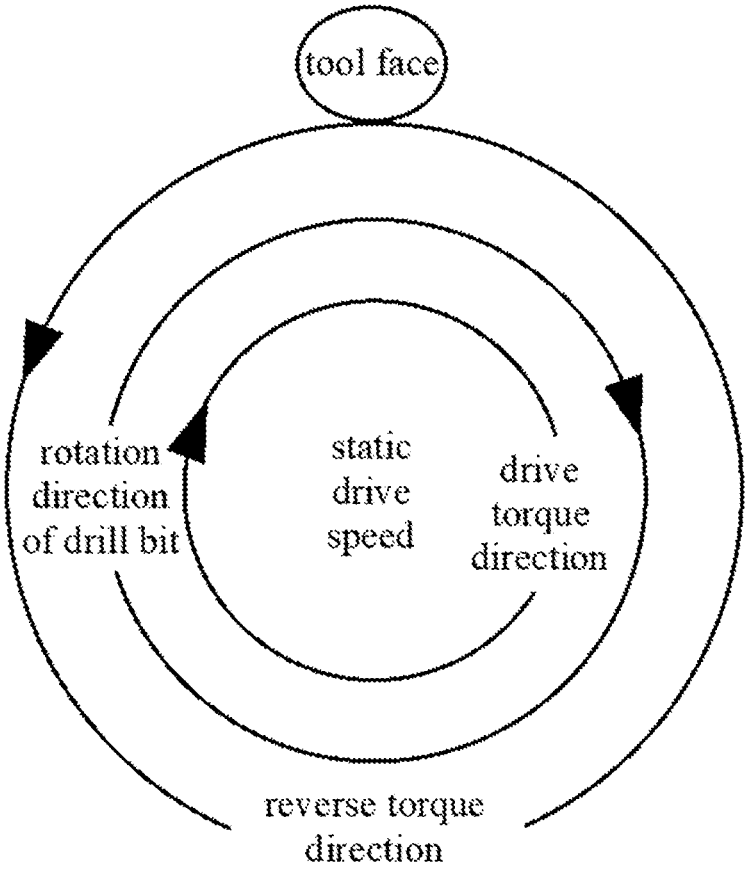
FIGS. 7A-B are tool face change relation diagrams.
Figure 7B:
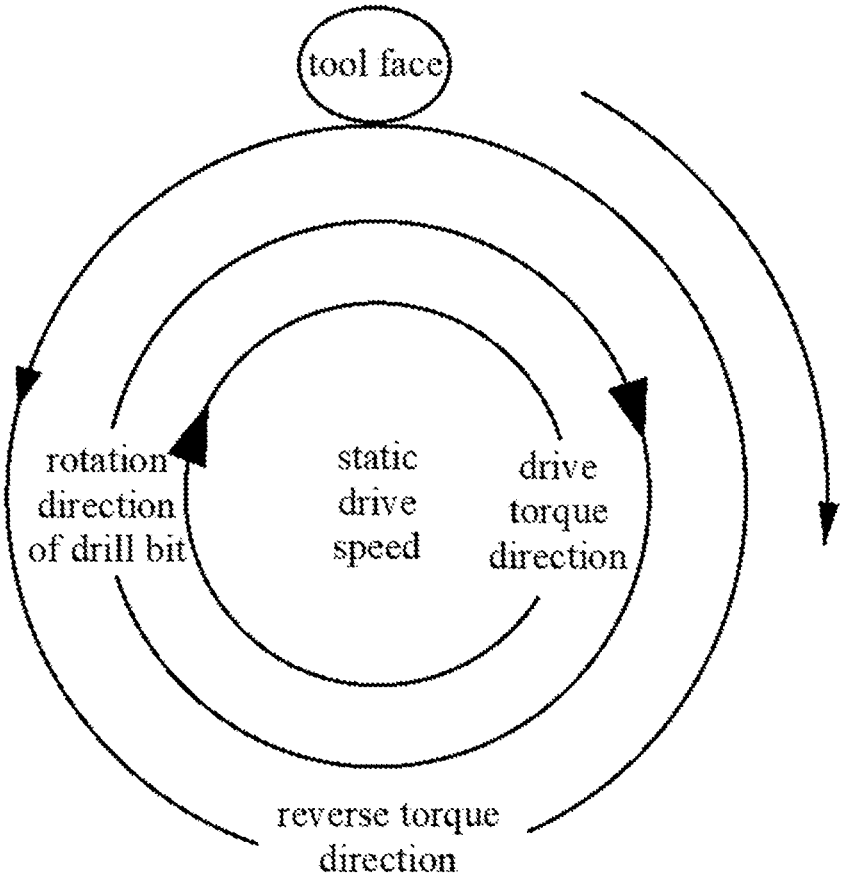
Figure 8:
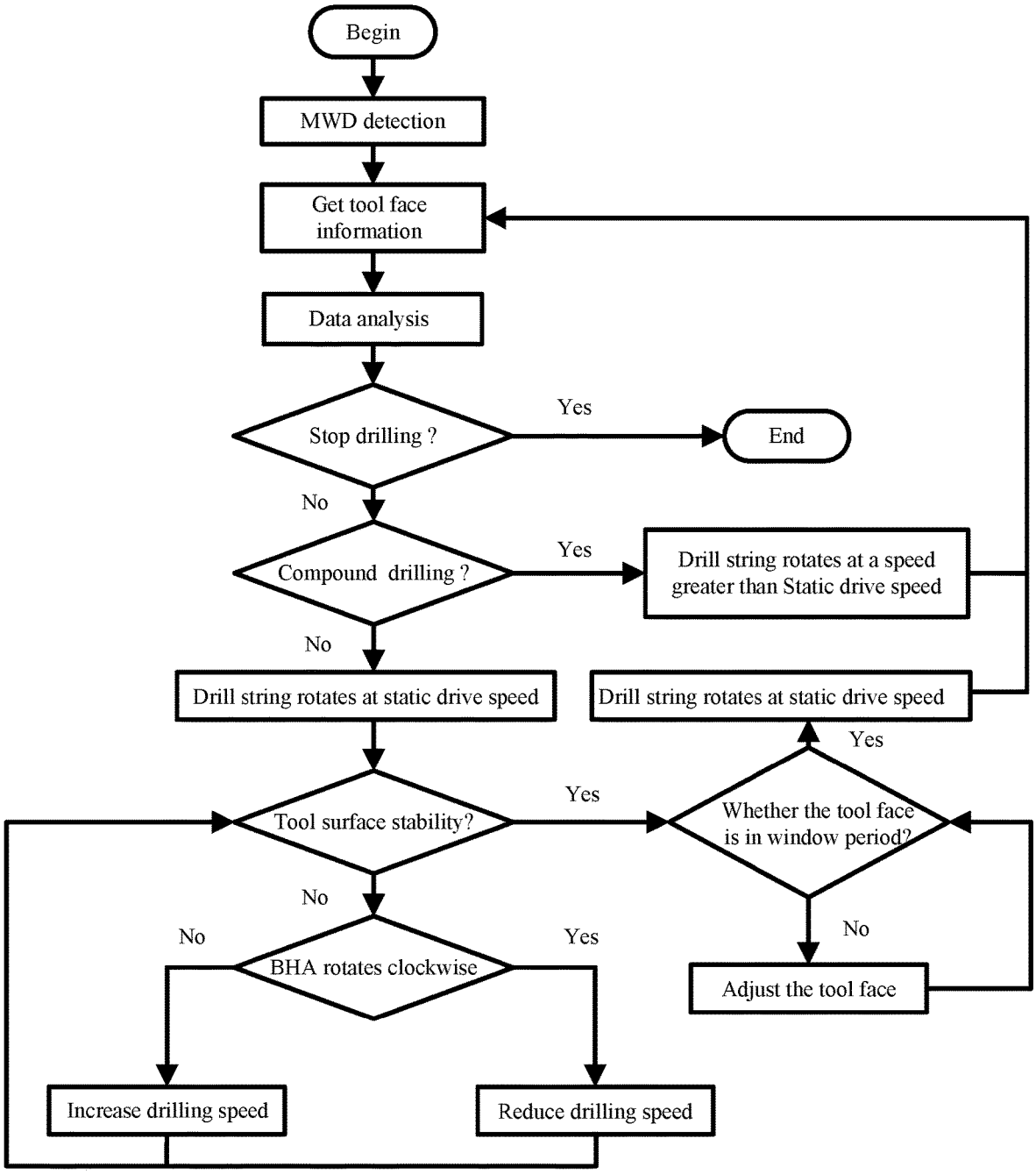
FIG. 8 is a flow chart of the operation of the full rotation controller of the directional well hydraulic clutch drill string.

Referring to FIGS. 7A-B, in one specific example, in short-term applications, the drill string is rotated at greater or less than the static drive speed, which can be used to adjust the tool face to set up directional drilling or during directional drilling. The tool face returns to the window period. In order to keep the controls as simple and reliable as possible, the directional well engineer needs to maintain control of the WOB. If the WOB of the drill bit changes during directional drilling, the reaction torque generated at the drill bit will also change, which will cause the tool face to change or become unstable. Therefore, if the control unit detects that the tool face has changed, it will adjust the driving speed to compensate for the change of the reaction torque caused by the change of the weight on bit, and correct the tool face to correspond to the target tool face.

Finally, it should be noted that the above descriptions are only certain embodiments of the present invention, and do not constitute any limitation to the present invention. Although the present invention has been described in detail with reference to the foregoing embodiments, for those skilled in the art, the technical solutions described in the foregoing embodiments can still be modified, or some technical features thereof can be equivalently replaced. Any modification, equivalent replacement, improvement, etc. made within the spirit and principle of the present invention shall be included within the protection scope of the present invention.

What is claimed:

1. A directional well hydraulic clutch drill string full rotation controller, comprising: a rotating assembly, a power assembly, and a control assembly; wherein the rotating assembly includes an upper mandrel, an upper bearing member, a first bearing positioning member, a second bearing positioning member, a bearing group, a lower bearing member, an upper casing, a rotating casing, an adapter, and a water cap joint; the rotating assembly rotates independently from the upper casing, the upper mandrel transmits a torque to an upper living hinge, the first bearing positioning member and the second bearing positioning member are adjacent to and position the bearing group, and the adapter and the water cap joint divide a drilling fluid;

the power assembly includes a cross universal joint shaft, a fluid conversion joint, a rotor, a stator housing, an inner bushing, a flexible shaft, a conversion housing, an upper cover, a first bearing, an oil duct, an oil sealing screw, a second bearing and a connecting head; the stator housing transmits a positive torque, and the flexible shaft balances a planetary motion of the rotor; and the control assembly includes a control housing, an anti-drop ring, a controller, a positioning sleeve, a central tube, a stability control mandrel, a cylindrical needle roller, a stability control housing and a flow control system circuit, wherein the control assembly is configured to control a magnitude of the positive torque and prevent the stator housing from reversing, so as to ensure a stability of a tool face.

2. The directional well hydraulic clutch drill string full rotation controller according to claim 1, wherein both the adapter and the water cap joint are configured with first through holes and second through holes.

3. The directional well hydraulic clutch drill string full rotation controller according to claim 2, wherein the drilling fluid flows through a cavity of the upper mandrel to a casing annulus from the first through holes and the second through holes.

4. The directional well hydraulic clutch drill string full rotation controller according to claim 3, wherein the water cap joint decelerates the drilling fluid.

5. The directional well hydraulic clutch drill string full rotation controller according to claim 3, wherein the fluid adapter includes a third through hole, so that a first part of the drilling fluid in the casing annulus flows into a cavity of the rotor, and a fourth through hole, so that a second part of the drilling fluid flows into a sealed cavity formed by the rotor and the inner bushing.

6. The directional well hydraulic clutch drill string full rotation controller according to claim 5, wherein the first and second parts of the drilling fluid flow through an L-shaped through hole into the stability control mandrel.

7. The directional well hydraulic clutch drill string full rotation controller according to claim 1, wherein the flexible shaft is hollow and has an upper end connected to an end of the rotor by threads, and a front end including a rubber part.

8. The directional well hydraulic clutch drill string full rotation controller according to claim 7, wherein the rubber part increases a service life of the flexible shaft.

9. The directional well hydraulic clutch drill string full rotation controller according to claim 7, further comprising a seal configured to prevent the drilling fluid from flowing into the cavity of the rotor, wherein the flexible shaft has a lower end connected with the connecting head.

10. The directional well hydraulic clutch drill string full rotation controller according to claim 1, wherein the upper cover is at an upper end of the connecting head and is configured to prevent the drilling fluid from flowing into an interior of the first bearing, the first bearing and the second bearing are inside the connecting head, the second bearing can rotate only in a positive direction, and the oil duct is between the first and second bearings.

11. The directional well hydraulic clutch drill string full rotation controller according to claim 10, wherein the oil duct is in the connecting head, and a lubricating oil can be injected through the oil duct before assembly.

12. The directional well hydraulic clutch drill string full rotation controller according to claim 11, wherein the oil duct comprises fifth through holes circumferentially distributed at 90° angles.

13. The directional well hydraulic clutch drill string full rotation controller according to claim 1, wherein the anti-drop ring and the positioning sleeve restrict movement of the controller.

14. The directional well hydraulic clutch drill string full rotation controller according to claim 13, wherein the controller includes six flow passages at equal circumferential intervals, and a piston configured to control a size of each of the flow passages.

15. The directional well hydraulic clutch drill string full rotation controller according to claim 14, wherein each of the flow passages has a size that adjusts a pressure difference between two ends of the controller.

16. The directional well hydraulic clutch drill string full rotation controller according to claim 14, further comprising a motor connected to the piston with a lead screw, wherein the piston is fixed with a lead screw nut, and the lead screw nut is driven to move axially by the motor.

17. The directional well hydraulic clutch drill string full rotation controller according to claim 16, wherein the controller comprises a receiving coil configured to receive signals to control the motor, and a power supply configured to supply power for the controller.

18. The directional well hydraulic clutch drill string full rotation controller according to claim 13, wherein the controller comprises an upper controller, a lower controller and splines with which the piston cooperates to achieve circumferential positioning and axial movement, and which cooperate to facilitate positioning of upper and lower flow channels during assembly.

19. The directional well hydraulic clutch drill string full rotation controller according to claim 1, wherein the flow control system circuit includes a main control circuit, a motor control circuit, a main control power supply circuit, a power conversion circuit, and a reset circuit.

20. The directional well hydraulic clutch drill string full rotation controller according to claim 1, wherein the stability control mandrel comprises a front end with an L-shaped through hole for the drilling fluid; the cylindrical needle roller is between the stability control mandrel and the stability control housing, and the cylindrical needle roller has a diameter smaller than a maximum gap of a groove of the stability control housing.

* * * * *